US005558575A

United States Patent [19]

Chiu et al.

[11] Patent Number: 5,558,575

[45] Date of Patent: Sep. 24, 1996

[54] SPARK PLUG WITH PLATINUM TIP PARTIALLY EMBEDDED IN AN ELECTRODE

[75] Inventors: Randolph K. Chiu, Davison; Mark J. Harris, Flushing, both of Mich.

[73] Assignee: General Motors Corporation, Detroit, Mich.

[21] Appl. No.: 441,095

[22] Filed: May 15, 1995

[51] Int. Cl.[6] ..... H01T 21/02

[52] U.S. Cl. ..... 445/7; 288/232; 219/78.13

[58] Field of Search ..... 445/7; 228/232; 219/78.13

[56] References Cited

U.S. PATENT DOCUMENTS

| | | | |
|---|---|---|---|
| 4,684,352 | 8/1987 | Clark et al. | 445/7 |
| 4,810,220 | 3/1989 | Moore | 445/7 |
| 4,881,913 | 11/1989 | Mann | 445/7 |
| 5,179,313 | 1/1993 | Eves et al. | 445/7 X |
| 5,456,624 | 10/1995 | Moore et al. | 445/7 |

*Primary Examiner*—Kenneth J. Ramsey

*Attorney, Agent, or Firm*—Cary W. Brooks

[57] ABSTRACT

Generally, the invention include a spark plug with a platinum tip partially embedded in one of the spark plug's electrodes. A spark plug according to the present invention may be prepared by first heating the area of the electrode where the platinum tip is to be attached to a temperature such that the platinum tip may be pushed into and embedded in the electrode. Thereafter the platinum tip is welded to the electrode. Heating the electrode allows the platinum tip to penetrate deeper into the electrode material. This deeper penetration or embedment will reduce the operating temperature at the weld interface (junction) which will in turn reduce the thermal stress and hence prevent cracking of the platinum tip. This deeper penetration or embedment will also reduce the rate of oxidation at the platinum tip near the weld junction and hence prevent cracking of the platinum tip.

10 Claims, 2 Drawing Sheets

SPARK PLUG WITH PLATINUM TIP PARTIALLY EMBEDDED IN AN ELECTRODE

FIELD OF THE INVENTION

The invention relates to spark plugs for combustion engines, and more particularly spark plugs with welded tips and methods of making the same.

BACKGROUND OF THE INVENTION

Disc-type or wire-type platinum tip spark plug electrodes have heretofore been known. These types of spark plugs are subject to failure such as cracking at the weld interface due to thermal fatigue caused by the thermal expansion mismatch between the spark plug tips, particularly platinum tips and the base electrode materials. Severe cracking can lead to the platinum tip falling off.

The present invention provides advantages over the prior art.

SUMMARY OF THE INVENTION

Generally, the invention includes a spark plug with a platinum tip partially embedded in a spark plug electrode. A spark plug according to the present invention may be prepared by first heating an area of the electrode where the platinum tip is to be attached to a temperature such that the platinum tip may be pushed into and embedded in the electrode. Thereafter the platinum tip is welded to the electrode. Heating the electrode allows the platinum tip to penetrate deeper into the electrode material. This deeper penetration or embedment will reduce the operating temperature at the weld interface which will in turn reduce the thermal stress and prevent cracking of the platinum tip because of thermal mismatch. This deeper penetration or embedment will also reduce the rate of oxidation at the platinum tip near the weld junction and hence prevent cracking of the platinum tip.

These and other objects, features and advantages of the present invention will become obvious from the following brief description of the drawings, detailed description and appended claims and accompanying drawings.

DETAILED DESCRIPTION

Figure 1:
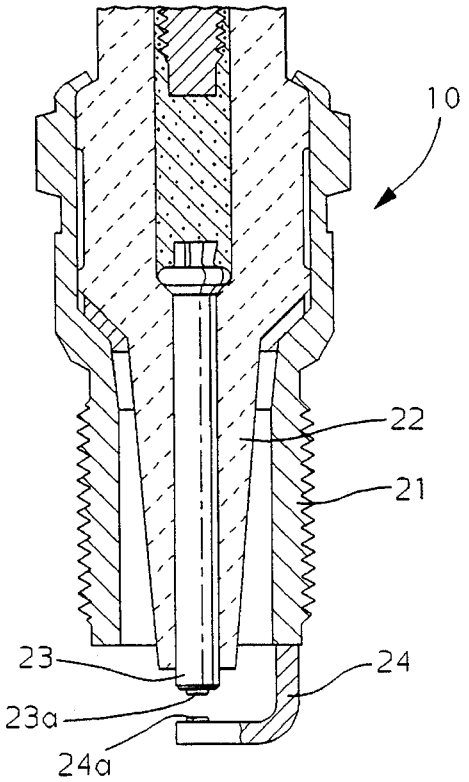
FIG. 1 is a sectional view of a spark plug having a disc-type spark tip according to the present invention.
Figure 2:
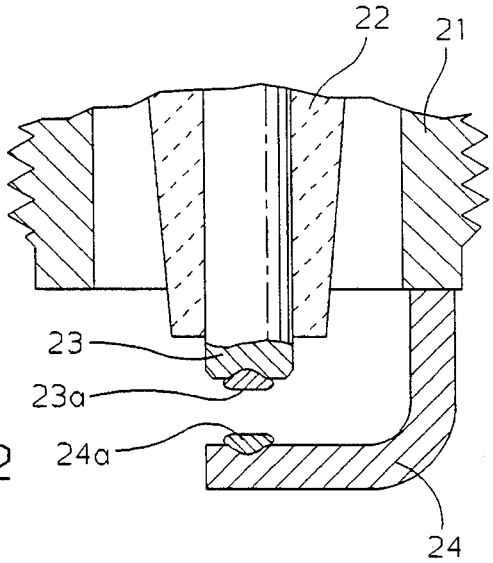
FIG. 2 is an enlarged, sectioned, partial view of a spark plug having a disc-type spark tip according to the present invention.
Figure 3:
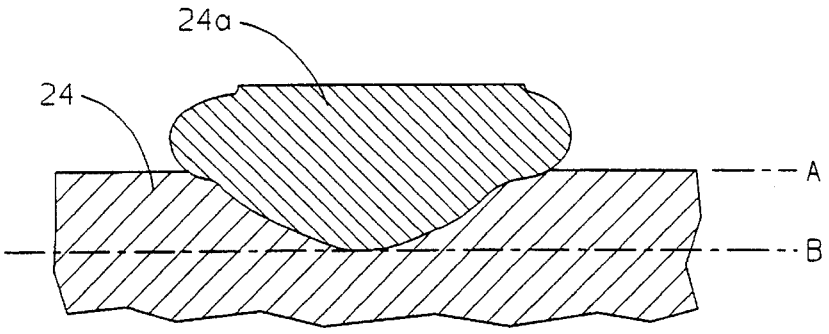
FIG. 3 is a magnified, sectional view of a disc-type spark tip embedded in a spark plug electrode according to the present invention.
Figure 4:
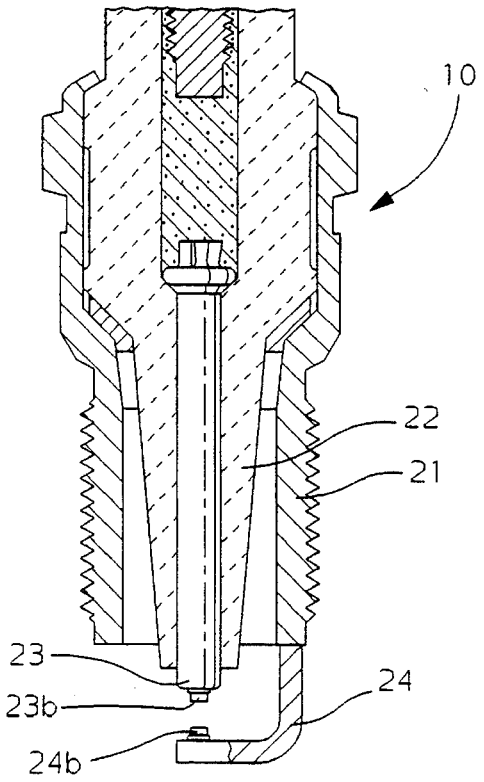
FIG. 4 is a sectional view of a spark plug having a pin-type spark tip according to the present invention.
Figure 5:
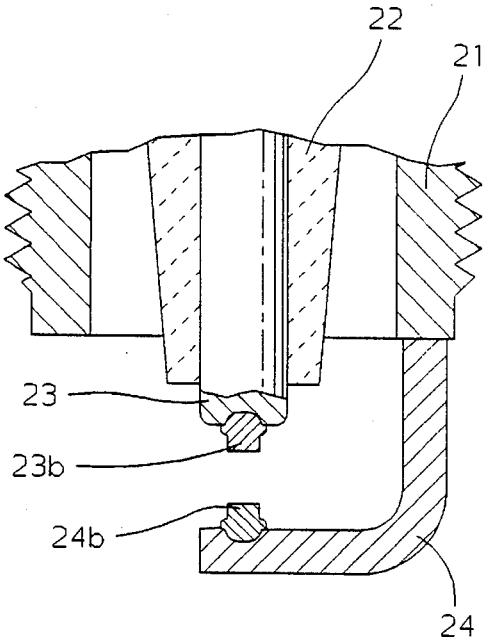
FIG. 5 is an enlarged, sectioned, partial view of a spark plug having a pin-type spark tip according to the present invention.
Figure 6:
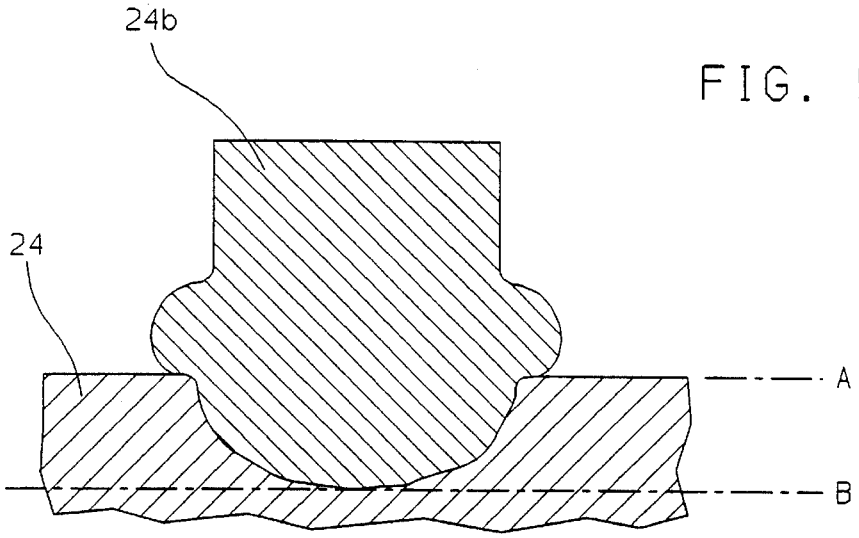
FIG. 6 is a magnified, sectional view of a pin-type spark tip embedded in a spark plug electrode according to the present invention.

A spark plug 10 has a ground electrode 24 including a platinum tip 24*a* (disc) or 24*b* (pin) and a center electrode 23 including a platinum tip 23*a* (disc) or 23*b* (pin). The center electrode 23 is surrounded by an insulator 22 and metal (steel) shell 21 according to the present invention is illustrated in FIGS. 1–6.

In a preferred embodiment a Fe—15Cr—4Al—type material is selected for an electrode of a spark plug. U.S. Pat. No. 4,881,913, the disclosure of which is hereby incorporated by reference, describes a suitable Fe—Cr—Al—type alloy.

According to the present invention, a portion of the electrode 23 or 24 (center or side/ground electrode) where a platinum tip is to be welded is heated by any of a variety of methods, but preferably by exposing the portion of the electrode to induction heating. Other methods of heating the electrode include flame heating and laser heating. A portion of the electrode is heated to about 1400° F. so that the platinum tip may be pushed by a welding force into the electrode so that the platinum tip is partially embedded into the electrode. Preferably the Fe—15Cr—4 Al material is chosen for the electrode because it matches closer to the thermal expansion of the platinum tip. However, nickel alloys and other alloys may be used for electrodes.

A typical disc platinum tip is embedded into an electrode about 0.15 mm without heating the end portion of the electrode. However, when the electrode is heated according to the present invention the tip is embedded about 0.24 mm, (distance between A–B of FIG. 3). In general, the embedment without heating is about 0.10–0.18 mm whereas with heating is always greater than 0.20 mm for disc-type tips. The disc-type platinum tip is resistance welded with a 0.5 mm diameter platinum wire. The welded wire is subsequently cut and coined (flattened) to form a disc diameter of about 1.00 mm.

A typical wire pin-type platinum tip having an embedment of 0.29 mm without heating the end portion of the electrode. However, when the electrode was heated according to the present invention, the embedment was 0.43 mm, (distance between A–B of FIG. 6). In general, the embedment without heating is less than 0.30 mm whereas with heating is always greater than 0.40 mm for wire pin-type tips. The wire pin-type platinum tip is resistance welded with a 0.9 mm diameter platinum wire. The welded wire is then cut and slightly flattened to a pin diameter of about 1.0 mm. The deeply embedded platinum tip (a) reduces the rate of oxidation at the weld junction and hence prevents cracking, (b) enables the temperature of the operating spark plug to be lower at the weld junction to reduce thermal stress and prevent cracking, and (c) anchors the wire-type tip into the base electrode to withstand turbulent forces of the operating vehicle engine. Obviously the step of heating the electrode may be accomplished by a variety of methods such as a torch, an induction heating coil, a laser or other suitable means sufficient to soften the electrode so that the platinum tip can be embedded deeply in the electrode.

What is claimed is:

1. A method of attaching a platinum tip to a spark plug electrode comprising:

heating a portion of the electrode to soften the electrode material;

pushing a portion of a platinum spark plug tip into the softened portion of the electrode; so that the platinum tip is embedded a distance of at least 0.2 mm in the electrode; and subsequently resistance welding the platinum tip to the electrode.

2. A method as set forth in claim 1 wherein the platinum tip is a disc type.

3. A method as set forth in claim 1 wherein the platinum tip is resistance welding with a 0.5 mm diameter platinum wire and is thereafter cut and coined to flatten it to a disc diameter of about 1.00 mm.

4. A method as set forth in claim 1 wherein said platinum tip is a pin type.

5. A method as set forth in claim 1 further comprising the steps of resistance welding the platinum tip with a 0.9 mm wire and slightly flattening the tip to a diameter of about 1.00 mm to form a pin-type platinum tip.

6. A method as set forth in claim 5 wherein the pin-type platinum tip is embedded a distance of at least 0.4 mm in the electrode.

7. A method as set forth in claim 1 wherein said electrode comprises a Fe—15Cr—4Al—type material having a thermal expansion coefficient substantially matching that of the platinum tip.

8. A method as set forth in claim 1 wherein the heating is performed by exposing the electrode to induction heating.

9. A method as set forth in claim 1 wherein the heating is performed by exposing the electrode to flame heat.

10. A method as set forth in claim 1 wherein the heating is performed by exposing the electrode to laser heating.

* * * * *